US006974236B2

(12) United States Patent
Tenmyo

(10) Patent No.: US 6,974,236 B2
(45) Date of Patent: Dec. 13, 2005

(54) ILLUMINATING APPARATUS

(75) Inventor: Yoshiharu Tenmyo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/354,744

(22) Filed: Jan. 30, 2003

(65) Prior Publication Data

US 2003/0147244 A1 Aug. 7, 2003

(30) Foreign Application Priority Data

Feb. 5, 2002 (JP) ..... 2002-028159
Feb. 7, 2002 (JP) ..... 2002-030962

(51) Int. Cl.[7] ..... F21V 5/02
(52) U.S. Cl. ..... 362/340; 362/327; 362/620
(58) Field of Search ..... 362/323, 330, 362/337, 339, 340, 31, 26, 331, 332, 327, 362/300, 336, 600, 606–609, 614, 617, 619, 362/920, 623, 624

(56) References Cited

U.S. PATENT DOCUMENTS 2,215,900 A * 9/1940 Bitner ..... 362/309
3,752,974 A * 8/1973 Baker et al. ..... 362/31
5,055,976 A * 10/1991 Arai ..... 362/17
5,055,978 A * 10/1991 Rogoff ..... 362/31
5,775,792 A * 7/1998 Wiese ..... 362/328
5,813,743 A * 9/1998 Naka ..... 362/16
6,011,929 A * 1/2000 Fuke et al. ..... 396/175
6,536,923 B1 * 3/2003 Merz ..... 362/327
6,547,423 B2 * 4/2003 Marshall et al. ..... 362/333
6,632,004 B2 * 10/2003 Sugawara et al. ..... 362/281

FOREIGN PATENT DOCUMENTS

CN 97122809.4 7/1998

* cited by examiner

*Primary Examiner*—Stephen Husar
*Assistant Examiner*—Hargobind S. Sawhney
(74) *Attorney, Agent, or Firm*—Cowan, Liebowitz & Latman, P.C.

(57) ABSTRACT

This specification discloses an illuminating apparatus having a light source and an optical unit disposed forwardly on the object side of the light source, the optical unit being provided with an incidence surface on which light from the light source is incident, a light emergence surface provided with a Fresnel lens, and a side reflecting surface for totally reflecting the light incident on the incidence surface toward the Fresnel lens, wherein the light totally reflected by the side reflecting surface is refracted by the Fresnel lens and efficiently irradiates the object.

3 Claims, 11 Drawing Sheets

ILLUMINATING APPARATUS

BACKGROUND OF THE INVENTION

1. Field of the Invention

This invention relates to an illuminating apparatus, and particularly to an illuminating apparatus suitable for an optical apparatus having no surplus in the vertical thickness thereof and a photographing apparatus using the same, and is suitable for being mounted, for example, on a portion of the main body of a camera (the main body of a photographing apparatus), and operatively associated with the photographing operation of the main body of the camera to efficiently apply illuminating light (flashlight) to an object side and photograph the object.

2. Description of the Prior Art

Heretofore, an illuminating apparatus used in a photographing apparatus such as a camera has been comprised of a light source and optical parts such as a reflector and a Fresnel lens for forwardly directing a beam emitted from the light source.

In such an illuminating apparatus, various propositions have heretofore been made in order to cause beams emitted from the light source in various directions to be efficiently condensed within a necessary illuminating angle of view. Particularly in recent years, there has been proposed an illuminating apparatus in which an optical member utilizing total reflection such as a prism or a light guide is disposed instead of the Fresnel lens so far disposed in front of the light source, whereby an improvement in condensing efficiency and the thinning of an optical system in the vertical direction thereof are made compatible.

As a proposition of this kind, as shown in Japanese Patent Application Laid-Open No. 10-115852 by the applicant, there has been proposed an illuminating optical system using a compact prism of high condensing efficiency which causes a beam incident from a light source onto an optical member to be condensed in a vertical direction by total reflection surfaces formed on upper and lower sides and in a horizontal direction by a cylindrical lens surface provided on an emergence surface.

Also, as shown in Japanese Patent Application Laid-Open No. 11-249209, there has been proposed an illuminating optical system in which in order to prevent lateral stripe-shaped uneven light distribution caused by the above-described construction, there is disposed another optical member having a plurality of cylindrical lenses formed on the emergence surface side of the optical member.

In recent years, in a photographing apparatus such as a camera, the downsizing of the apparatus itself has been advancing more than heretofore. Particularly as a recent tendency, a desire to make the vertical height of the camera small is strong and along therewith, also for a strobo flash emitting portion located on the upper portion of the camera, a desire to reduce the vertical thickness thereof is strong. From such a background, it is strongly desired to put a thin type strobo optical system free of the deterioration of optical performance to practical use.

So, the applicant has proposed in Japanese Patent Application Laid-Open No. 10-115852 a thin type light emitting portion having its vertical thickness suppressed by utilizing a total reflection optical system which is little reduced in efficiency in spite of reflecting a plurality of times. This is an illuminating optical system of a thin type and good efficiency constructed by causing a beam incident from an illuminating light source onto an optical member to be condensed in a vertical direction (the diametral direction of a flashlight discharge tube) by total reflection surfaces formed on the upper and lower sides of the optical member to thereby achieve thinning, and to be efficiently condensed in a horizontal direction (the lengthwise direction of the flashlight discharge tube) by a cylindrical lens surface provided on the emergence surface of the optical member.

Referring to FIG. 11A of the accompanying drawings which is a schematic cross-sectional view of a flashlight emitting apparatus as such an illuminating apparatus, the reference numeral 2 designates a flashlight discharge tube such as a xenon tube having a light emitting source enclosed in a cylindrical glass tube, and the reference numeral 103 denotes a reflector, and the flashlight discharge tube 2 is mounted on the arcuate portion 103*a* thereof having an inner diameter shape substantially coinciding with the outer diameter shape of the flashlight discharge tube 2. This reflector 103 is such that the upper and lower reflecting surfaces 103*b* and 103*b*' forwardly opening from the upper and lower ends of the arcuate portion 103*a* are formed into flat surfaces. The reference numeral 104 designates the above-described total reflection type optical member, and the incidence surface 104*a* thereof is disposed in the opening portion of the reflector 103, and the incident light of the flashlight discharge tube 2 emerges from a forward emergence surface 104*b*. Also, the upper and lower sides 104*c* and 104*c*' of this optical member are formed into flat total reflection surfaces, and reflect a beam obliquely incident on the incidence surface 104*a* and causes it to emerge from the forward emergence surface 104*b*.

On the other hand, as the evils of the thinning of the strobo optical system by the above-described method, there are the facts that the light distribution at a point of time whereat the light from the light source 2 is incident on the optical member 104 is non-uniform (the light is not uniformly incident on the whole of the incidence surface 104*a* of the optical member 104) and that in an actual product, space is limited and a sufficient length for uniformization cannot be secured, and therefore, as shown, for example, in FIGS. 11B to 11D of the accompanying drawings, beams painted in black become light portions and white portions among them become dark portions, and in each state, the total area of these light portions is not constant and thus, uneven light distribution on the irradiated surface has occurred. That is, the light portions and the dark portions have extended from left to right and have not been recognized as a plurality of lateral stripe-shaped uneven light distributions in which light portions and dark portions are formed alternately in a vertical direction.

As a remedy for this, as shown in Japanese Patent Application Laid-Open No. 11-249209, it has been proposed to adopt an illuminating optical system in which one more optical member formed with a plurality of cylindrical lenses is disposed on the emergence surface 104 side of the optical member 104, to thereby prevent uneven light distribution relatively efficiently without using a diffusing plate.

In this proposition for preventing lateral stripe-shaped uneven light distribution, however, the one more optical member is required and this has led not only to an increase in cost, but also to the necessity of an extra space in the longitudinal direction of the optical system.

Also, in terms of an optical characteristic, even a component which originally need not be diffused is changed and therefore, components outside the necessary illuminating angle range are somewhat produced, and the above-described remedy has not always been an efficient method of preventing uneven light distribution.

Also, the above-described prior art has lacked the consideration of effectively utilizing light spreading from left to right.

Also, related applications include U.S. Pat. Nos. 6,078,752, 6,467,931 and 6,400,905.

SUMMARY OF THE INVENTION

From the foregoing, the greatest task to be achieved by the present invention is to propose a thin type illuminating optical system comprised of necessary minimum parts and most effectively using a given opening area, and to efficiently condense a beam hitherto not effectively used without adding any other part and increase a condensing property.

It is an object of the present invention to provide an illuminating apparatus which is made extremely thin as compared with conventional illuminating optical systems and can utilize energy from a light source highly efficiently to effect illumination keeping a uniform light distribution characteristic on an irradiated surface and which is suitable for a still camera, a video camera or the like, and a photographing apparatus using the same.

One aspect of the present invention discloses an illuminating apparatus comprising:

a light source; and an optical unit disposed forwardly on the object side of the light source;

the optical unit being provided with an incidence surface on which light from the light source is incident, a light emergence surface provided with a Fresnel lens, and a side reflecting surface for totally reflecting the light incident on the incidence surface toward the Fresnel lens;

wherein the light totally reflected by the side reflecting surface is refracted by the Fresnel lens and emerges toward the object side thereof.

Particularly, the angle formed between an edge surface of the Fresnel lens which is near to the optical axis of the optical unit and that optical axis is greater away from the optical axis.

Also, the illuminating apparatus has a reflecting member disposed on a side of the light source which is opposed to the optical unit for reflecting the light from the light source to the optical unit side.

Also, the light source is a light emitting tube, and the vertical angle of the Fresnel lens is formed along a direction perpendicular to the lengthwise direction of the light emitting tube.

Another aspect of the present invention discloses an illuminating apparatus comprising:

a light source;

an optical unit disposed forwardly on the object side of the light source;

the optical unit being provided with an incidence surface on which light from the light source is incident, a reflecting surface for totally reflecting some of the light incident from the incidence surface, and a light emergence surface; and a reflecting member disposed on a side of the light source which is opposed to the optical unit for reflecting the light from the light source to the optical unit side;

wherein the inclination of a tangent on the reflecting surface on the light emergence surface side of the optical unit with respect to the optical axis of the optical member or the inclination of a tangent on the reflecting member on the incidence surface side with respect to the optical axis of the optical member gradually increases toward the direction of travel of the light.

Another aspect of the present invention discloses an illuminating apparatus comprising:

a light source;

an optical unit disposed forwardly on the object side of the light source;

the optical unit being provided with an incidence surface on which light from the light source is incident, a reflecting surface for totally reflecting some of the light incident from the incidence surface, and a light emergence surface; and a reflecting member disposed on a side of the light source which is opposed to the optical unit for reflecting the light from the light source to the optical unit side;

wherein the opening diameter of the reflecting member on the incidence surface side gradually increases toward the direction of travel of the light.

A further aspect of the present invention discloses an illuminating apparatus comprising:

a light source; and an optical unit disposed forwardly on the object side of the light source;

the optical unit being provided with an incidence surface on which light from the light source is incident, a reflecting surface for totally reflecting some of the light incident from the incidence surface, and a light emergence surface;

wherein a diffusing portion is formed on at least a portion of the reflecting surface.

Further features of the present invention will become apparent from the accompanying drawings and the following description.

DESCRIPTION OF THE PREFERRED EMBODIMENTS

Figure 1A:
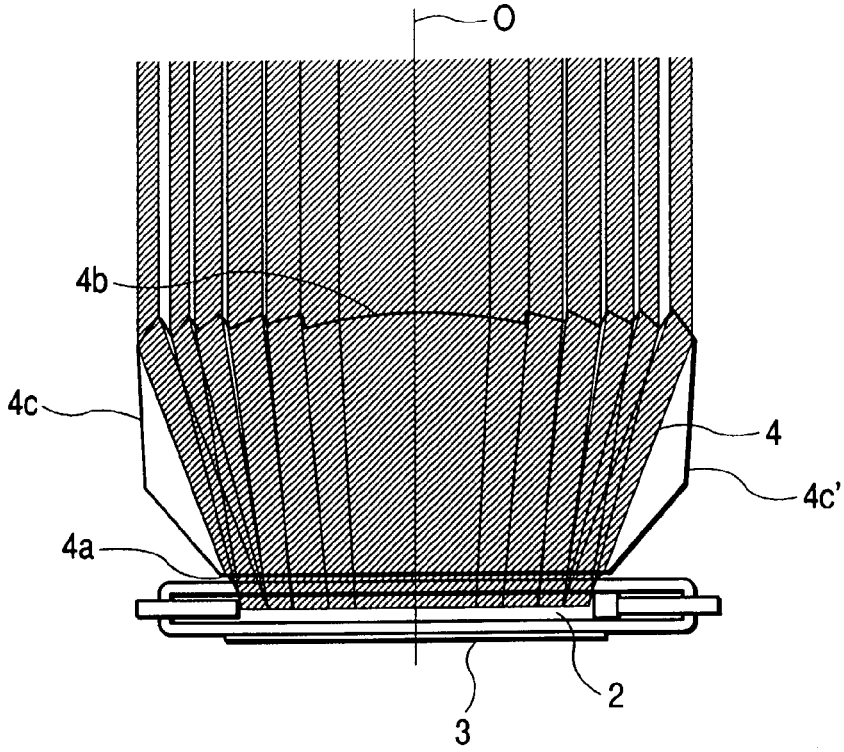
FIGS. 1A and 1B are cross-sectional views of the optical system of a flashlight emitting apparatus according to a first embodiment of the present invention taken along the axial direction of the flashlight discharge tube thereof.
Figure 1B:
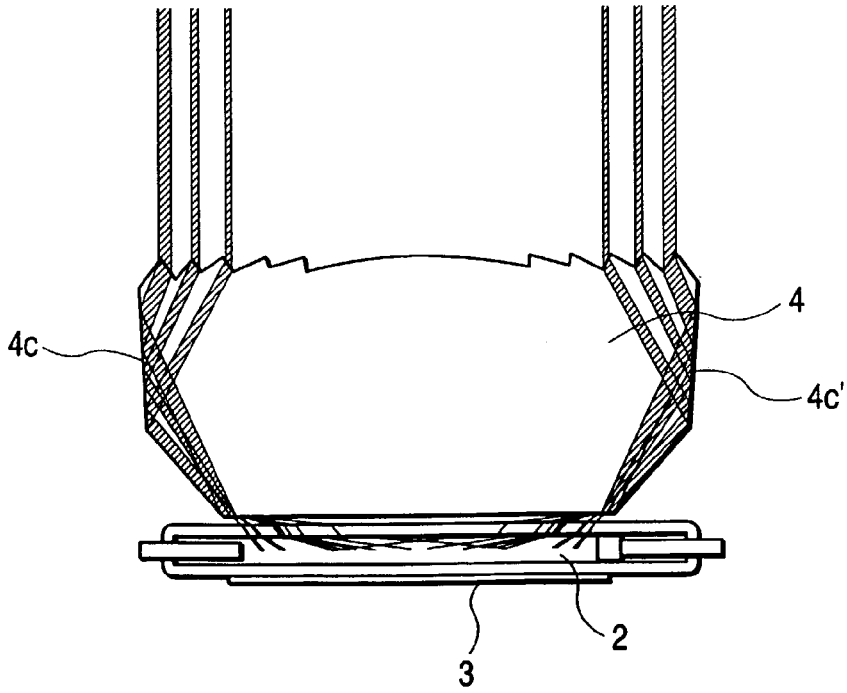
Figure 2:
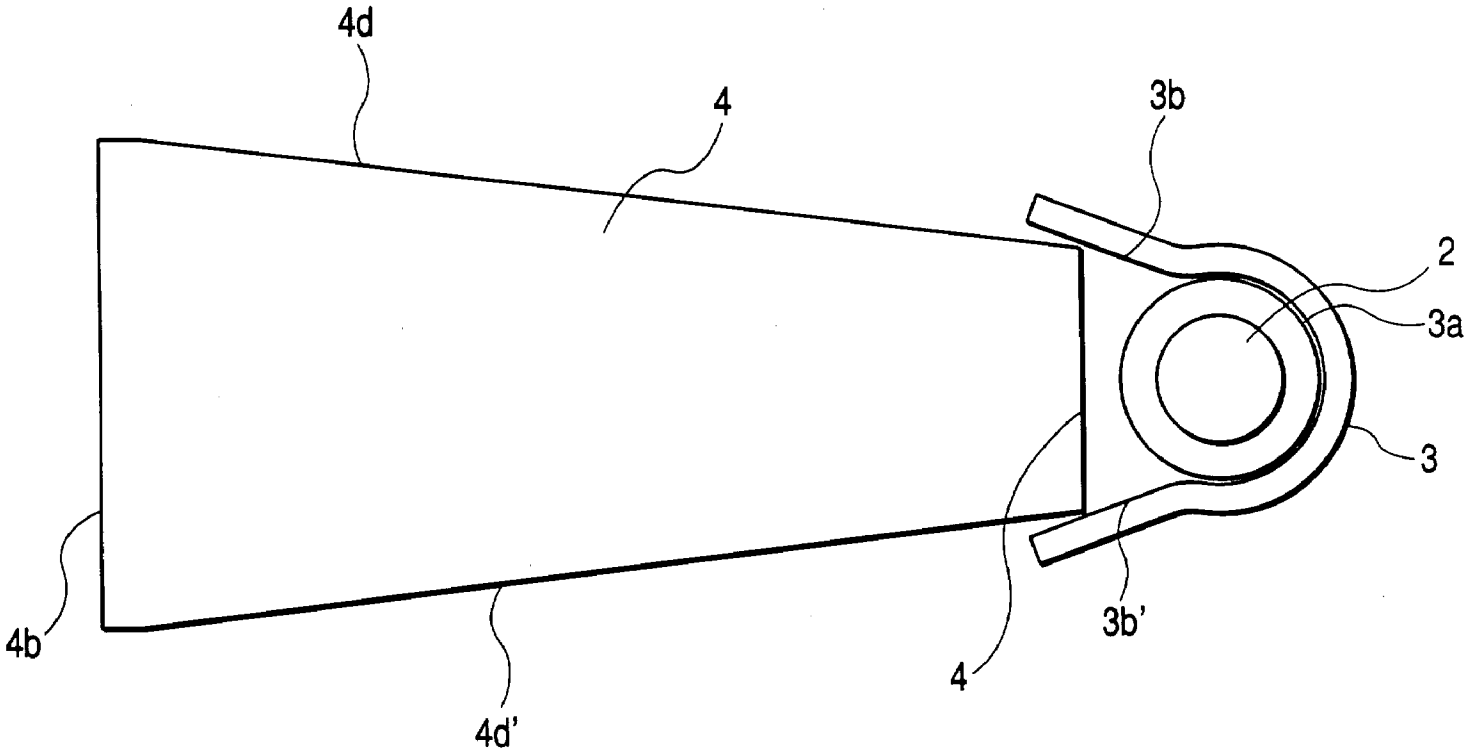
FIG. 2 is a longitudinal cross-sectional view of the optical system of the flashlight emitting apparatus according to the first embodiment of the present invention taken along the diametral direction of the flashlight discharge tube thereof.
Figure 3:
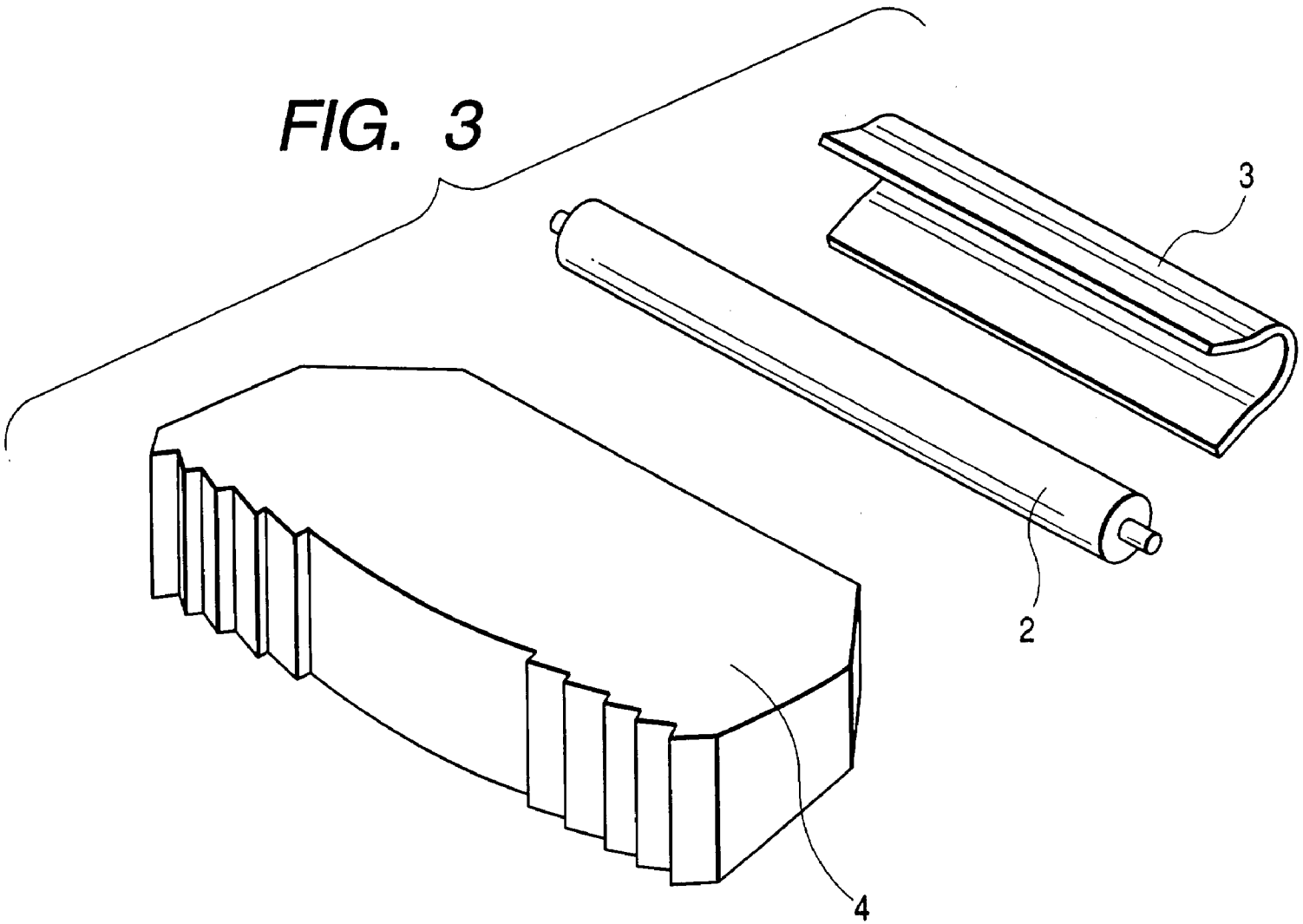
FIG. 3 is an exploded perspective view of only the main optical system of the flashlight emitting apparatus according to the first embodiment of the present invention.
Figure 4:
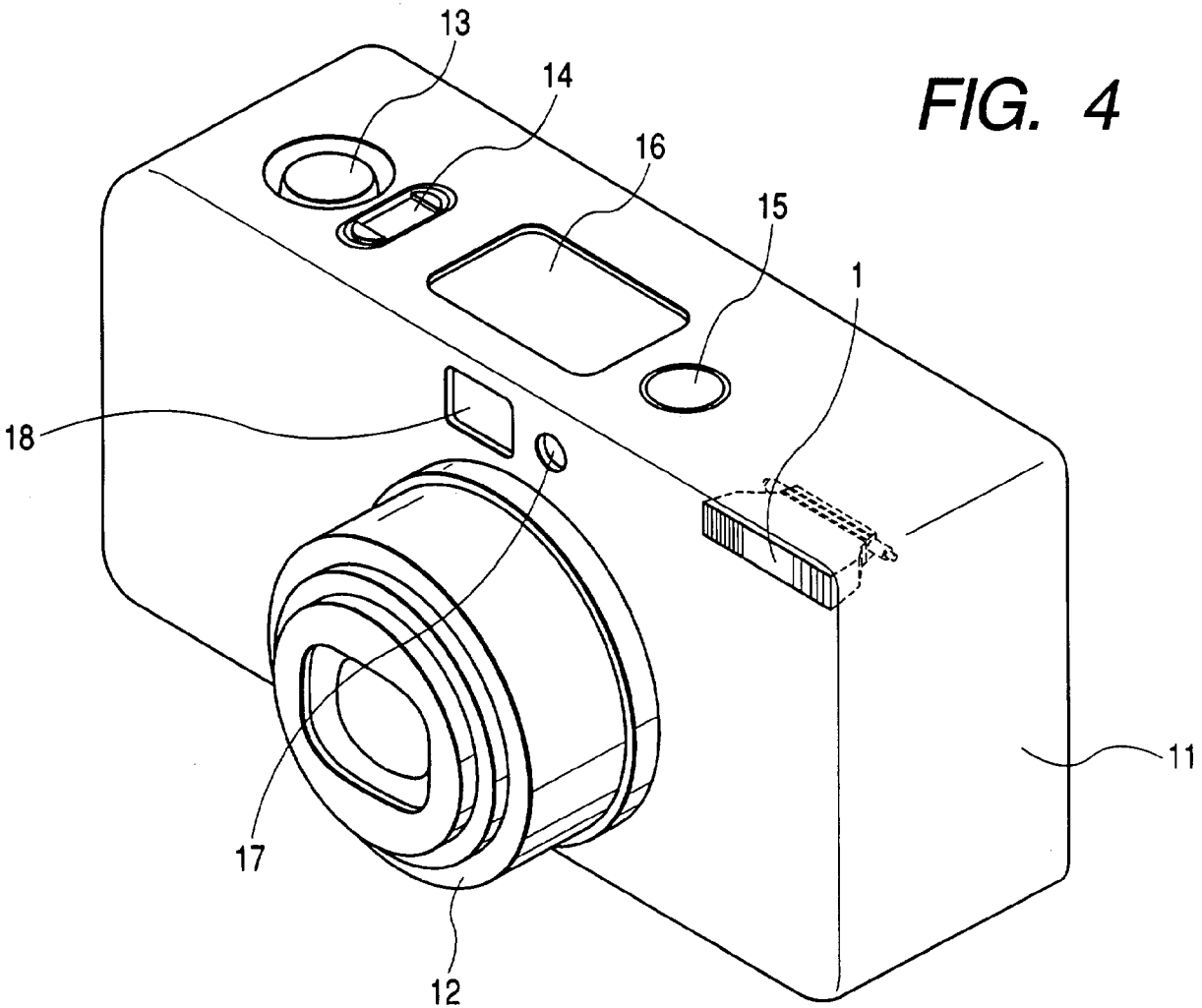
FIG. 4 is a perspective view of a camera to which the flashlight emitting apparatus according to the first embodiment of the present invention.

FIGS. 1A, 1B and FIGS. 2 to 4 show an illuminating apparatus according to a first embodiment of the present invention, and particularly in the present embodiment, a flashlight emitting apparatus, FIGS. 1A and 1B being cross-sectional views of essential portions constituting the optical system of the flashlight emitting apparatus taken along a plane containing the center axis of the flashlight discharge tube thereof, FIG. 2 being a longitudinal cross-sectional view of the essential portions constituting the optical system of the flashlight emitting apparatus, FIG. 3 being an exploded perspective view of only the main optical system of the flashlight emitting apparatus, and FIG. 4 being a perspective view of a camera to which the present invention is applied. In FIGS. 1A and 1B, there is also shown the trace of a representative ray of light emitted from a light source.

FIGS. 1A and 1B show the optical path of only a beam travelling toward the center of an optical axis on an irradiated surface among beams emitted from the light source with respect to the same cross-sectional shape, and show an area actually used among the parts of the illuminating optical system so that by what optical path a component on the irradiated surface travelling toward the center of the optical axis is formed can be specified.

The flashlight emitting apparatus according to the present embodiment, as shown in FIG. 4, is disposed on the right upper portion of the main body of a camera as viewed from the front of the main body of the camera, and an emission window is in a vertically thin form formed with a longitudinal Fresnel lens.

In FIG. 4, the reference numeral 1 designates a flashlight emitting portion, the reference numeral 11 denotes the main body of a photographing apparatus, the reference numeral 12 designates a lens barrel provided with a photo-taking lens, the reference numeral 13 denotes a release button, and the reference numeral 14 designates an operating member for zooming the photo-taking lens, and when this operating member 14 is brought down forwardly, the photo-taking lens can be zoomed in the telephoto direction, and when the operating member is brought down rearwardly, the photo-taking lens can be zoomed in the wide direction. The reference numeral 15 denotes an operating button for changing over the various modes of the camera, the reference numeral 16 designates a liquid crystal display window for informing a user of the operation of the camera, the reference numeral 17 denotes the peep window of a photometric device for measuring the brightness of outdoor daylight, and the reference numeral 18 designates the peep window of a finder. The functions of the respective parts except the flashlight emitting portion are known and therefore need not be described in detail herein. The mechanical constituents of the present invention are not restricted to the aforedescribed ones.

The constituents prescribing the optical characteristic of the flashlight emitting portion which is the prime object of the present invention will now be described in greater detail with reference to FIGS. 1A, 1B and FIGS. 2 to 3.

In these figures, the reference numeral 2 denotes a cylindrical flashlight discharge tube (xenon tube) emitting flashlight and having the left-to-right direction as the lengthwise direction thereof. The reference numeral 3 designates a reflector for causing a component of a beam emitted from the flashlight discharge tube 2 which travels rearwardly in a light emission direction to be reflected in the light emission direction, and it is formed of a metallic material such as bright aluminum having its inner surface formed by a high reflectance surface or a resin material or the like having a metal vapor-deposited surface of high reflectance formed on the inner surface thereof. The reference numeral 4 denotes an illuminating beam directing optical member for causing the beam directly emitted from the flashlight discharge tube 2 and a beam incident by being reflected by the reflector 3 to be efficiently applied to the object side. An optical resin material of high transmittance such as acrylic resin or a glass material is suitable as the material of the optical member 4.

In the above-described construction, when the photographing apparatus 11, as is known in the prior art, is set, for example, to a "strobo auto mode," a central processing unit, not shown, judges whether the flashlight emitting apparatus should be made to emit light, by the brightness of outdoor daylight measured by a photometric device, not shown, and the sensitivity of inserted film, after the release button 13 has been depressed by the user. When the central processing unit judges that "the flashlight emitting apparatus should be made to emit light" under a photographing situation, the central processing unit outputs a light emitting signal, and makes the flashlight discharge tube 2 emit light through a trigger lead wire, not shown, attached to the reflector 3. As regards emitted beams, the beam emitted in a direction opposite to the irradiation optical axis is incident on the optical member 4 disposed on the front face via the reflector 3, and the beam emitted in the irradiation direction is directly incident on the optical member 4, and these beams are converted into a predetermined light distribution characteristic through this optical member 4, whereafter they are applied to the object side.

The present invention is the proposition of an illuminating apparatus in which the general shape of particularly the illuminating optical system of a photographing apparatus is made extremely thin and yet the light distribution characteristic of the then necessary irradiation range is kept uniform, and a method of setting this optimum shape will hereinafter be described in greater detail with reference to FIGS. 1A, 1B and FIG. 2.

FIGS. 1A and 1B are cross-sectional views of essential portions constituting the optical system of the flashlight emitting apparatus according to the first embodiment of the present invention taken along a plane containing the center axis of the flashlight discharge tube, and show the basic way of thinking for achieving the optimization of the condensing characteristic in the left-to-right direction. FIGS. 1A and 1B show the same cross-sectional views and also add the ray tracing portion of a beam applied toward the center of the optical axis (O) on the irradiated surface. The numbers of the respective portions in FIGS. 1A and 1B correspond to those in FIGS. 2 and 3. The center of a beam travelling toward an object by the optical member shown in FIGS. 1A and 1B is defined as the optical axis.

As shown in FIG. 1A, a beam emitted from the flashlight discharge tube 2 is incident on the incidence surface 4*a* of the optical member 4, and thereafter emerges from a Fresnel lens surface 4*b* formed on an emergence surface side. At this time, it will be seen that there exists a beam travelling from an area of a width wider than the length of an arc which is the substantial light emission range of the flashlight discharge tube toward the emergence optical axis of an irradiated surface by the refractive power of the Fresnel lens, and a condensing effect is obtained. However, as can be seen from FIG. 1A, when a Fresnel lens is formed to give the condensing action, a discontinuous point is created in the edge portion of the Fresnel lens, and there exists an area which does not contribute to the area of the opening portion of the optical system in the direction of the emergence optical axis (O). Also, it will be seen that this phenomenon often occurs in a peripheral area far from the center of the light emitting portion. That is, it will be seen that a great condensing effect by refraction is obtained by the Fresnel lens being used, while on the other hand, the opening portion of the illuminating optical system becomes wider than necessary and there is not provided an optical system good in space efficiency which uses the whole surface of an original opening.

In the present embodiment, the opening portion of an area in which a beam travelling in the direction of the emergence optical axis does not exist on such a Fresnel lens surface is effectively used to form an efficient optical system. Also, by this effect, there is constructed an optical system for deriving the greatest guide number in a given opening area.

In order to adopt such a construction, in the present embodiment, the contrivance of the shape of each portion of the optical member 4 as shown in FIG. 1B is made. That is, the side portions 4*c* and 4*c*' of the optical member 4 are made into an optimum curved surface shape, and the light is totally reflected by these surfaces. Further, the beam after totally reflected is directed to the edge surface of the Fresnel lens portion, and is refracted by this edge surface to thereby newly form an optical path for letting the beam travel in the direction of the emergence optical axis. Thereby, a beam shown in FIG. 1B is added to the beam shown in FIG. 1A and thus, there exists a beam travelling from almost the whole of the emergence surface 4*b* of the optical member in the direction of the emergence optical axis, and an optical system most effectively utilizing the opening area can be constructed.

In the present embodiment, the surface shape of the total reflection surfaces 4*c* and 4*c*' of the optical member 4 is a cylindrical lens shape of R50 (the radius of curvature 50 mm) contacting with the emergence surface of the Fresnel lens. This cylindrical lens surface is a shape given a curvature on the plane of the drawing sheet of FIGS. 1A and 1B, but given no curvature in a direction perpendicular to the plane of the drawing sheet. Also, the inclination of the edge surface of the Fresnel lens is varied so that the angle of each surface may become acuter (greater) away from the center of the optical axis of the Fresnel lens surface so as to make the beam after refracted travel in the direction of the emergence optical axis by this edge surface. The edge surface of the Fresnel lens refers to one of two surfaces constituting the Fresnel lens which is nearer to the optical axis of the Fresnel lens.

This is for the purpose of preventing a component refracted by the edge portion of the Fresnel lens after the total reflection from being one-sided in a predetermined direction on the irradiated surface. That is, the continuous variation in the inclination of the edge portion of the Fresnel lens and the curving of the total reflection surfaces 4*c* and 4*c*' are operatively associated with each other to thereby make the contrivance of such a shape that the continuity of the light distribution characteristic is not destroyed.

While in the construction of the present embodiment, the shape of the total reflection surfaces 4*c* and 4*c*' of the optical member 4 is a cylindrical lens surface of a constant curvature (R50) of which the center axis is on the optical axis side and exists more adjacent to the irradiated surface than the Fresnel lens surface, this shape is not restrictive, but various shapes which can give an effect similar to that of this shape may be adopted. For example, the total reflection surface on the side may also be constituted by a plurality of surface shapes differing in inclination from one another. Further, the cylindrical lens surface shape is not restrictive, but various quadratic surface shapes or a three-dimensional curved surface shape such as a toric surface shape may also be adopted.

Also, in the present embodiment, design is made such that the angle of the edge portion of the Fresnel lens with respect to the center of the optical axis in the direction of travel of the light is made gradually greater toward the peripheral portion, and this is because away from the center of the light source, an area in which refraction is possible by the refracting surface of the original Fresnel lens becomes gradually smaller and therefore it becomes unnecessary to erect the Fresnel edge surface more than necessary. Also, from the fact that the area easy to control by the side total reflection portions 4*c* and 4*c*' of the optical member 4 is an area near to these total reflection surfaces, it is effective when viewed as the whole of the optical system to make the inclination of the edge portion of the Fresnel lens null to thereby increase this totally reflected light component.

Also, the Fresnel lens surfaces, as shown in FIG. 3, are arranged in a direction substantially perpendicular to the lengthwise direction of the light source.

The shape of the optical system of the flashlight emitting apparatus in the vertical direction thereof will now be described with reference to the cross-sectional view of FIG. 2.

First, the cross-sectional shape of the reflector 3 is such that the shape thereof rearward of the emergence optical axis is a semicylindrical shape (3*a*) substantially concentric with the flashlight discharge tube 2. This is a shape convenient to return the reflected light by the reflector to the vicinity of the central portion of the light source, and is effective to make it difficult for the reflector to be adversely affected by the refraction or total reflection in the glass portion of the flashlight discharge tube. Also, by constructing so, the reflected light by the reflector can be treated as a beam substantially equivalent to the direct light from the light source and therefore this shape is easy to conceive of, and the whole of the optical system subsequent thereto can be made most compact and this is convenient.

On the other hand, the portions 3*b* and 3*b*' of the reflector 3 which are forward of the light source and near to the emergence surface are formed into such an aspherical shape that the increase rate of the opening area becomes greater toward the emergence end portion. This shape is effective as means for alleviating uneven light distribution occurring in a glass tube having a discharge tube sealed therein and at the discontinuous points of the optical system, and can condense the light while having a uniform light distribution characteristic.

Description will now be made of the shape of the optical member 4 disposed on the emergence surface of the reflector 3. As shown, the portion between the incidence surface 4*a* and emergence surface 4*b* of the optical member 4 is formed by inclined surfaces 4*d* and 4*d*' having their incidence surface sides made into planar surfaces and having their emergence surface sides made into a shape gradually greater in the change of the inclination and gradually fanwise from the incidence surface toward the emergence surface. These inclined surfaces 4*d* and 4*d*' constitute total reflection surfaces, thus constituting a very efficient reflecting optical system in which the loss of the quantity of light by reflection is very small. Also, by adopting this optical system to thereby effect plural times of reflection and gradually control the condensation of a divergent beam, it is possible to make a construction in which the irradiation angle in a vertical direction is suppressed to a constant range and the vertical height is minimized. This will hereinafter be described in detail with reference to FIGS. 5A to 5D.

FIGS. 5A to 5D are longitudinal cross-sectional views of the flashlight emitting apparatus according to the first embodiment of the present invention taken along the diametral direction of the discharge tube thereof, and show a basic way of view for achieving the optimization of the light distribution characteristic in the vertical direction. FIGS. 5A to 5D all show the same cross-sectional views, and in FIGS. 5B to 5D, the ray trace portion of the beam applied in a particular angle direction on the irradiated surface is added to the cross-sectional views.

Prior to the description of each portion, description will first be made of the epitome of the fractor of the occurrence of uneven light distribution considered to be most important in thinking of the prevention of uneven light distribution which is the object of the present invention.

In such an optical system as effects the condensation of light in the vertical direction as shown in the present embodiment by the repetitive reflection by a plurality of reflecting members, discontinuous points are liable to occur to the light distribution characteristic from a change in reflectance and a sudden change in the shape of the reflecting surfaces, near the boundary portions between the respective reflecting surfaces such as from the reflector 3 to the optical member 4, and from the optical member 4 to the outside of the optical member. These discontinuous points have been a cause of the lateral stripe-shaped uneven light distribution on the irradiated surface.

As another cause of the uneven light distribution, mention can be made of the fact that in the flashlight discharge tube which is a light source, there is interposed a glass tube portion for sealing therein xenon gas which is a light emitting material. That is, if light emission is not effected from this glass portion, unnecessary total reflection will be caused by the inner wall of the glass tube at the same time, and this phenomenon also causes the discontinuous points in the light distribution characteristic. Particularly, the thicker is this glass tube portion as compared with the inner diameter of the flashlight discharge tube which actually emits light, the more liable to be caused becomes discontinuous points differing in characteristic from one another, and as the result, the phenomenon of uneven light distribution has been caused.

Moreover, as regards the uneven intensity of this kind for each angle, because of the fact that the xenon discharge tube which is the light source is elongate and the vertical cross sections of the optical member are often of substantially the same shape, uneven light distribution occurs at the same angle of the respective vertical cross sections and at the same time, and this has been liable to appear as continuous linear uneven light distribution horizontally extending in a particular angle area on the irradiated surface. This horizontally extending linear unevenness has been easy to discriminate particularly as the characteristic of the human eyes, and has been liable to be recognized as uneven light distribution more remarkable than the actual difference between light and shade.

The characteristic shape of the optical system in the present embodiment for eliminating the causes of the occurrence of the uneven light distribution as noted above will hereinafter be described in order.

First, the reflector 3 is formed with a semicylindrical arcuate portion 3*a* formed into an inner diametral shape substantially coinciding with the outer diametral shape of the flashlight discharge tube 2 contained therein, rearwardly on the emergence optical axis. This is a shape convenient to return the reflected light by the reflector 3 to the vicinity of the central portion of the light source, and is effective to make it difficult to be adversely affected by the refraction or total reflection by the glass portion of the flashlight discharge tube 2. Also, by constructing so, the reflected light by the reflector 3 can be treated as a beam substantially equivalent to the direct light from the light source and therefore, this is easy to conceive of, and the whole of the optical system subsequent thereto can be made most compact, and this is convenient.

On the other hand, the upper and lower widening reflecting surfaces 3*b* and 3*b*' forward of the reflector 3 have their portions near to the emergence surface forward of the light source formed into such an aspherical shape that the increase rate of the opening area becomes greater toward the emergence end portion. The upper and lower widening reflecting surfaces 103*b* and 103*b*' of the reflector 103 of FIGS. 11A to 11D shown as an example of the prior art are inclined so that the vertical distance therebetween may become longer toward the emergence end portion, but these reflecting surfaces 103*b* and 103*b*' are flat surfaces.

Heretofore, almost all of the shapes of the reflectors of strobo optical systems of this kind have been increased in the opening area (or the opening diameter) toward the emergence end portion, but have been gradually decreased in the increase rate. That is, it is often the case that as the cross-sectional shape of the reflector, use is made of an elliptical shape or a quadratic curve approximate to a half portion of an elliptical shape, and unexceptionally, there are seen only a few examples in which the cross-sectional shape of the reflector is formed by a parabolic surface intended to give priority to a light condensing property or a flat surface giving priority to downsizing, and there has been no example in which as in the present embodiment, the rate of the opening area (opening diameter) is increased.

In such prior-art optical systems, it is often the case that the light distribution characteristic in a vertical direction is regulated chiefly by only this reflector, and the above-described shapes are considered to have been adopted for the purpose of suppressing the opening area of the emergence surface to a necessary minimum size.

On the other hand, in the construction of the illuminating optical system according to the present embodiment, unlike the prior art, the regulation of the light distribution characteristic in the vertical direction is effected chiefly by the optical member 4 disposed further forwardly of the reflector 3.

That is, the illuminating optical system according to the present embodiment adopts a construction in which the optical member 4 for controlling the light distribution characteristic in the vertical direction by total reflection is disposed on the front surface of the emergence opening portion of the reflector 3 to thereby suppress the illuminating angle in the vertical direction to a constant range, and plural times of reflection is utilized to thereby minimize the vertical height.

As described above, the control of the light distribution characteristic in the vertical direction is regulated chiefly by the total reflection by the optical member 4 disposed forwardly of the reflector 3, but it is important in uniformizing light distribution to continuously change the reflected light from the arcuate portion 3*a* rearward of the light source and the totally reflected light from the optical member 4 in the vertical direction on the emergence surface 4*b* of the optical member 4.

In the present embodiment, in order to achieve this object, the shape of the vicinity of the emergence portion of the reflector 3 is made into such a shape as gives a reflection characteristic continued to the totally reflected light from the optical member 4.

It is desirable that the shape of the emergence surface side of the reflector 3 at this time be in such angular relationship as satisfies the following expression when the inclination of the upper and lower reflecting surfaces of the optical member formed by flat surfaces with respect to the emergence optical axis O is defined as θ and the refractive index of the optical member 4 is defined as n and when the inclination of a tangent on the reflector immediately before the incidence onto the optical member 4 is defined as α.

$$\mathrm{Sin}(\alpha) \cong n^{*}\mathrm{Sin}(\theta) \quad (1)$$

By satisfying the above expression (1), there is obtained a continuous distribution of reflected light as a reflection angle characteristic although the reflectances of the upper and lower reflecting surfaces 3*b* and 3*b*' of the reflector 3 and the total reflection surface of the optical member 4 differ from each other.

The inclination a of the tangent on the emergence surface of the reflector 3 is regulated by the above-mentioned expression (1). Description will now be made of a shape linking this inclination and the reflecting surface of the rearward arcuate portion 3*a* together.

It is desirable that the shape of the upper and lower reflecting surfaces of the reflector 3 which are near the emergence surface be a curved surface continuously connected from the arcuate portion 3*a* rearward of the light source to the angle α of the tangent of a curve near the incidence surface 4*a* of the optical member 4. By the reflector 3 being formed into such a shape, there is no discontinuous point in a reflected component, and there can be obtained a uniform light distribution characteristic free from uneven light distribution.

Actually, however, there is the adverse effect of the glass tube of the discharge tube 2 and therefore, it does not always provide an optimum shape to start an aspherical shape continuously from the arcuate portion 3*a*.

As is seen in the shape of the present embodiment, a curved surface causing this continuous angular change is started from somewhat forward of the center of the light source which does not reenter into the glass portion of the flashlight discharge tube 2, whereby the unnecessary loss of the quantity of light can be obviated.

On the other hand, another feature of the shape of the illuminating optical system of the present invention is that the total reflection surface shape of at least the neighboring portions 4*b* and 4*b*' of the emergence surface of the total reflection surfaces 4*c* and 4*c*' of the optical member 4 is formed by such a curved surface shape that like the shape of the vicinity of the emergence surface of the reflector 3, the increase rate of the opening area becomes greater toward the emergence end 4*b*. Particularly, the shape of the optical member 4 in the present embodiment is, relative to an inclined flat surface shape continued from the incidence surface 4*a*, such a curved surface shape as contacts with this inclined flat surface.

Regarding the curved surface shape in the neighboring portions 4*b* and 4*b*' of the emergence surface at this time, an optimum curvature β exists, and even if this curvature is too small or too great, a uniform light distribution characteristic cannot be obtained. As an experimental numerical solution, though it depends on the inclination of the total reflection surface, it is desirable that the curvature be within the following range of curvature (mm):

$$R30 \leqq \beta \leqq R300 \quad (2)$$

When in the above expression, β is less than R30 which is the lower limit value, not only the beam near the emergence portion 104*b* of the optical member 4 is slightly diffused, but also is greatly changed and therefore, a light distribution narrower than the original illuminating angle range is provided, and not only a light distribution of a desired range is not obtained, but also new uneven light distribution due to overcorrection becomes liable to occur. Also, when β is greater than R300 that is the upper limit value, diffusibility is not sufficient and uneven light distribution cannot be sufficiently eliminated, but lateral stripe-shaped uneven light distribution will remain.

In the present embodiment, the curvature of the vicinity of the emergence surface is regulated to R110 which is substantially intermediate of the above-mentioned range, and is optimized so that the uneven light distribution on the irradiated surface may become minimum.

While in the present embodiment, the shape of the upper and lower neighboring portions 4*b* and 4*b*' of the emergence surface 104*b* of the optical member 4 is a cylindrical surface of a constant curvature, this shape need not always be a curved surface of a constant curvature, but may of course be an aspherical surface or a quadratic curved surface having an effect equivalent to the effect of the curved surface of a constant curvature.

Next, in order to describe that the present embodiment is effective for uneven light distribution, the process in which uneven light distribution occurs will be described in detail while an example of the prior art shown in FIGS. 11A to 11D in which the shape of the upper and lower reflecting surfaces 103*b* and 103*b*' near the emergence surface of a reflector 103 is a flat surface and the vicinity of the emergence surface of the upper and lower total reflection surfaces 104*c* and 104*c*' of an optical member 104 is also formed by only a flat surface is contrasted with a modification of the first embodiment in which as shown in FIGS. 9A to 9D, only the shape of the vicinity of the emergence surface of the upper and lower reflecting surfaces 3*b* and 3*b*' of the reflector 3 is formed by a shape in which as in the present embodiment, the increase rate of the area of the emergence surface becomes greater, and the optical member 104 is combined with the construction shown in FIG. 7.

Figure 9A:
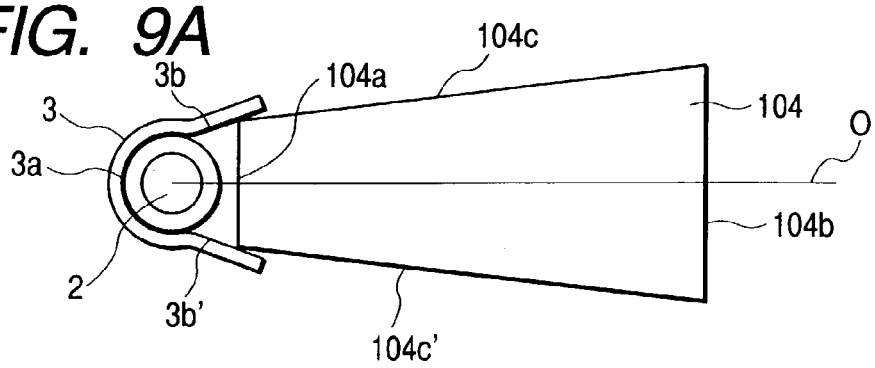
FIGS. 9A, 9B, 9C and 9D are longitudinal cross-sectional views of the optical system of a flashlight emitting apparatus according to a modification of the first embodiment taken along the diametral direction of the flashlight discharge tube thereof.
Figure 9B:
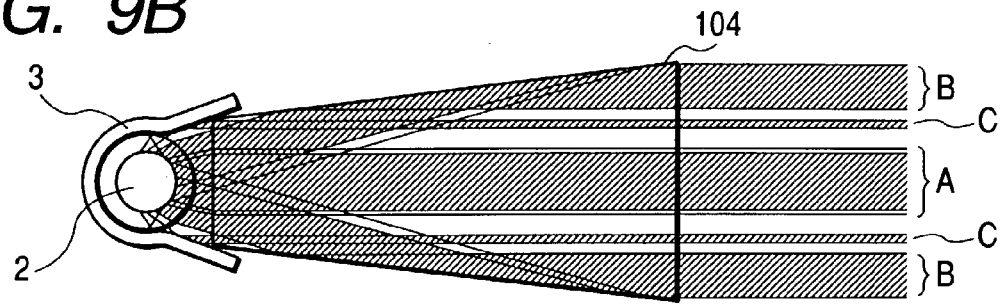

Description will first be made of a beam travelling substantially in the same direction as the direction of the emergence optical axis shown in FIGS. 5B, 9B and 11B.

Figure 5A:
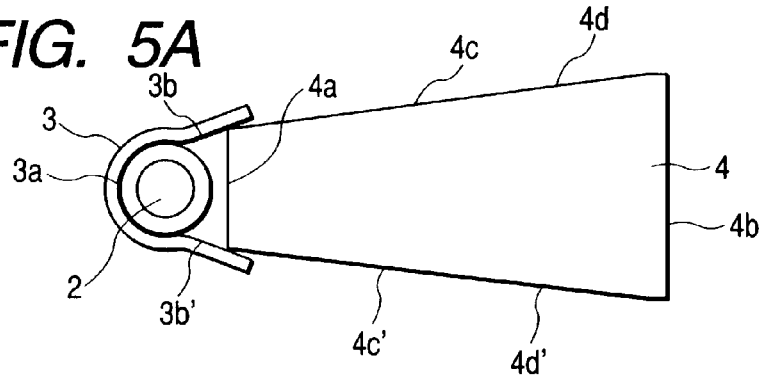
FIGS. 5A, 5B, 5C and 5D are longitudinal cross-sectional views of the optical system of the flashlight emitting apparatus according to the first embodiment of the present invention taken along the diametral direction of the flashlight discharge tube thereof.
Figure 5B:
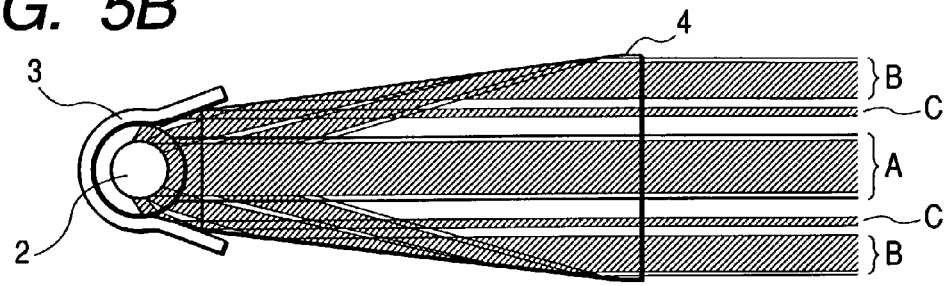

In FIG. 5B which shows an embodiment of the present invention, it will be seen that as regards the beam contributing to the direction of the emergence optical axis, the direct light from the flashlight emitting tube 2 which is the light source, one-time reflected lights by the upper and lower widening reflecting surfaces 3*b* and 3*b*' of the reflector 3, and one-time reflected lights by the upper and lower total reflection surfaces 4*c* and 4*c*' of the optical member 4, i.e., five kinds of beams in total, contribute.

Here, it is a great feature that between the direct light A from the light source and the totally reflected light B from the optical member 4, the reflected light C by the reflector 3 exists, though in a narrow area. This state is substantially similar also in the case of the present modification of the first embodiment shown in FIG. 9B.

Figure 11A:
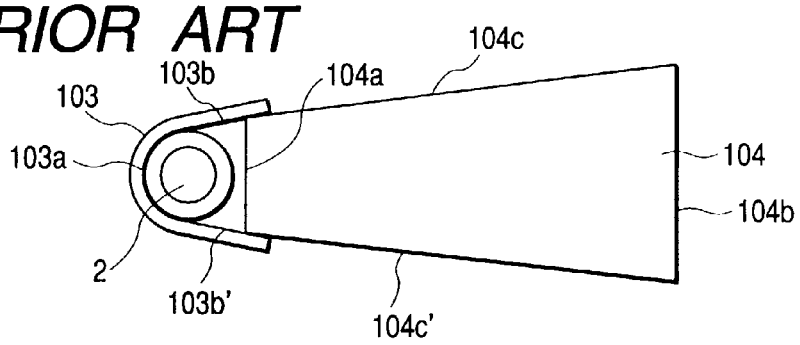
FIG. 11A PRIOR ART
FIGS. 11A, 11B, 11C and 11D are longitudinal cross-sectional views of the optical system of the conventional flashlight emitting apparatus in contrast with the first embodiment taken along the diametral direction of the flashlight discharge tube thereof.
Figure 11B:
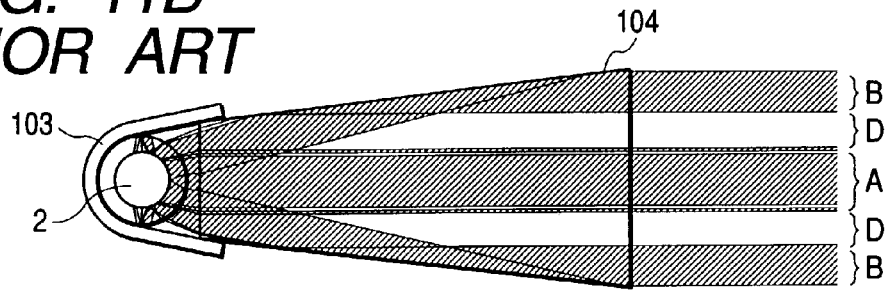
FIG. 11B PRIOR ART

On the other hand, in the case of the example of the prior art shown in FIG. 11B, the upper and lower widening reflecting surfaces (emergence surfaces) 103*b* and 103*b*' of the reflector 103 and the reflecting surfaces 104*c* and 104*c*' of the optical member 104 are all formed by flat surfaces and therefore, there only exist the direct light A from the flashlight emitting tube 2 which is the light source and the totally reflected light B by the reflecting surfaces 104*c* and 104*c*' of the optical member 104, and between the respective beams, there exists an area D in which there is no beam travelling in the direction of the emergence optical axis with a great width.

As described above, according to the optical system of the present invention, the optical path is broadly divided into three kinds and five layers of components, i.e., the direct light A, the reflected light C by the reflector 3 and the reflected light B by the optical member 4, and in this optical system, a great gap is not created between the respective areas.

On the other hand, in FIG. 11B wherein the reflecting surfaces 103*b* and 103*b*' of the reflector 103 are formed by flat surfaces, it will be seen that the direct light A travelling toward the center of the emergence optical axis and the reflected light B by the reflecting surfaces 104*c* and 104*c*' of the optical member 104 exist at separate positions.

On the other hand, according to the present embodiment, originally there is no area in which a beam does not exist in the boundary portion between such respective areas, but a continuous beam exists even in the boundary portion, whereby there is obtained a uniform light distribution characteristic free of uneven light distribution.

However, as described above with regard also to the cause of uneven light distribution, a glass tube which is a discharge tube sealing member actually exists in the flashlight discharge tube 2, and the discontinuity in this portion causes uneven light distribution.

So, it is also desirable as a method of obviating uneven light distribution to adopt a construction for minimizing the influence of the discontinuous portion by such a glass tube.

In the present embodiment, in order to practise this condition, contrivance is made particularly in the shape of the immediate vicinity of the glass tube which is the discontinuous portion, i.e., the vicinity of the emergence opening portion of the reflector 3, so as to provide such a surface shape that a beam reaching this area can be reliably obtained as reflected light in a wide angle range, though in a narrow area, that is, such a shape that gives such an outward curvature as widen the opening portion, or in other words, that the area of the opening portion increases toward the opening portion.

As described above, by the upper and lower widened reflecting surfaces 3*b* and 3*b*' of the reflector 3 being made into such a shape that the area of the above-described opening portion increases toward the opening portion, the illuminance distribution of each angular component always comes to have a plurality of reflected light components differing in characteristic from one another and this is effective to make the presence of the discontinuous point of the beam inconspicuous and achieve the uniformization of light distribution.

Figure 5C:
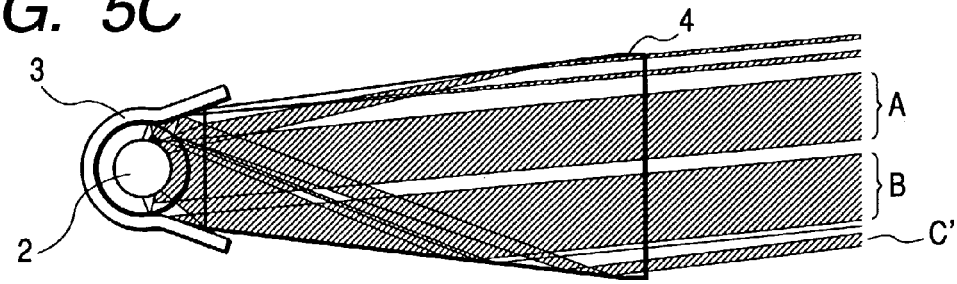
Figure 9C:
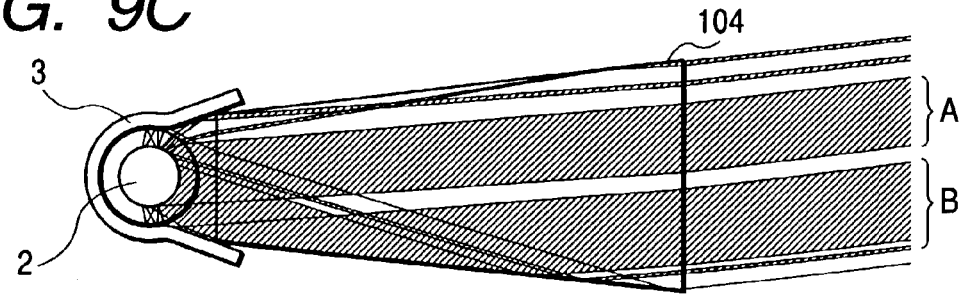
Figure 11C:
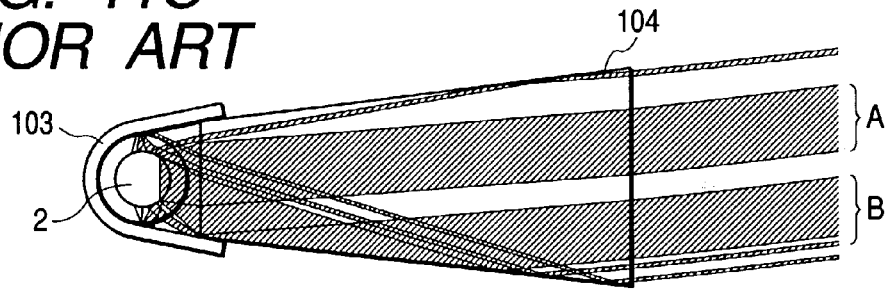
FIG. 11C PRIOR ART

Next, consider with attention paid to a beam travelling toward an angle (in the present embodiment, upwardly 6°) at which just the reflected light components by the upper reflecting surfaces 4*c* and 104*c* of the optical members 4 and 104 become almost null in a direction inclined from the optical axis by a predetermined angle, as shown in FIGS. 5C, 9C and 11C.

In this case, as shown in FIG. 5C, it will be seen that in the present embodiment, the reflected light component by the upper reflecting surface 4*c* of the optical member 4 is becoming null, but so as to make up for this, two-time reflected light C' resulting from the beam reflected by the upper widened reflecting surface 3*b* of the reflector 3 being further totally reflected by the lower reflecting surface 4*c*' of the optical member 4 is increased. Thereby, illuminance is maintained so as to become uniform on the irradiated surface as well and therefore, it is difficult for uneven light distribution to occur.

On the other hand, when as shown in FIGS. 9C and 11C, at least one of the upper and lower reflecting surfaces (emergence surfaces) 103*b* and 103*b*' of the reflectors 103 and 3 and the upper and lower reflecting surfaces 104*c* of the optical member 104 is made into a flat surface (angle component of about 6°), unlike the case of the present embodiment shown in FIG. 5C, the two-time reflected light by the total reflection by the upper widening reflecting surfaces 103*b* and 3*b* of the reflectors 103 and 3 and the lower reflecting surface 104*c* of the optical member 104 is insufficient or scarcely exists and thus, the beam of this angle component decreases.

Thereby, on the irradiated surface, a dark portion is created in this angle area of about 6°, and as the light distribution on the irradiated surface, a dark area is created as compared with the lateral stripe-shaped surroundings.

Figure 11D:
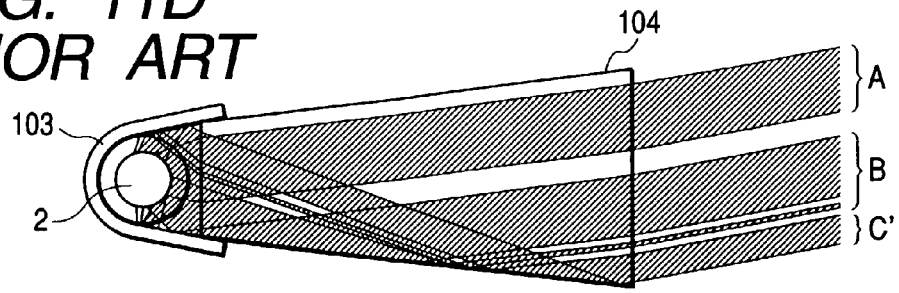
FIG. 11D PRIOR ART

The case of an angle (in the present embodiment, upwardly about 10°) at which the totally reflected components by the upper total reflection surfaces 4*c* and 104*c* of the optical members 4 and 104 become entirely null will now be described with reference to FIGS. 5D, 9D and 11D.

Figure 5D:
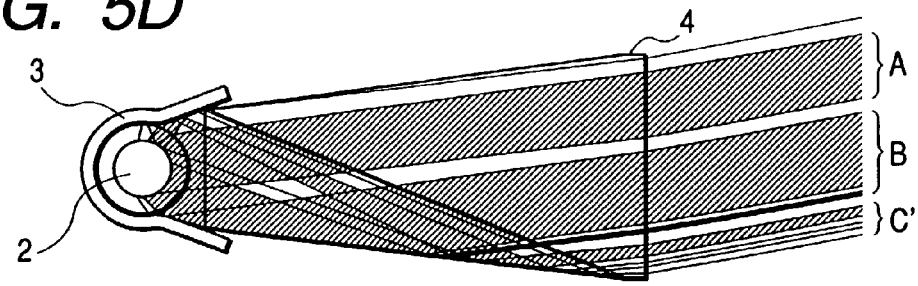

As shown in FIG. 5D, a two-time reflected component C' reflected by the upper widened reflecting surface 3*b* of the reflector 3, and further totally reflected by the lower surface of the optical member 4 exists continuedly from the state of FIG. 5C. Therefore, there is no sudden change in light and shade in the light distribution characteristic, and a substantially uniform illuminance distribution is obtained.

Figure 9D:
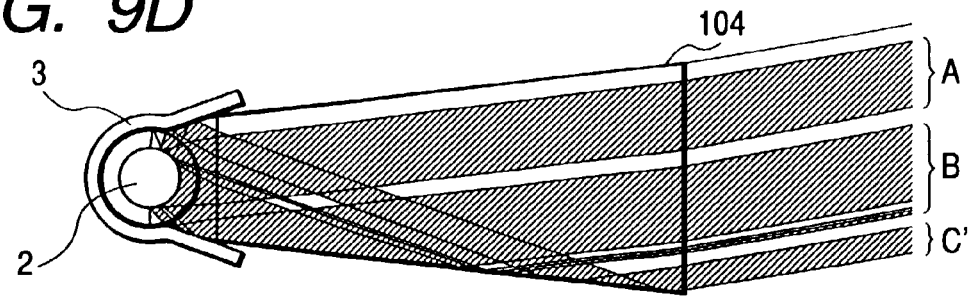

On the other hand, in the states shown in FIGS. 7D and 9D, the two-time reflected component C' resulting from the beam reflected by the upper widening reflecting surfaces 103*b* and 3*b* of the reflectors 103 and 3 being totally reflected by the lower total reflection surface 104*c*' of the optical member 104 is suddenly increased, and constitutes a light portion as the light distribution characteristic on the irradiated surface. Particularly, when the upper widening reflecting surface 103*b* of the reflector 103 and the lower total reflection surface 104*c*' of the optical member 104 in FIG. 11D showing the example of the prior art are made into flat surfaces, this increase becomes remarkable and the irradiated surface becomes extremely bright. As the light distribution characteristic in this case, a light layer is created adjacent to the outside of an area which has once become dark and therefore, uneven light distribution is made more remarkable.

Figure 6:
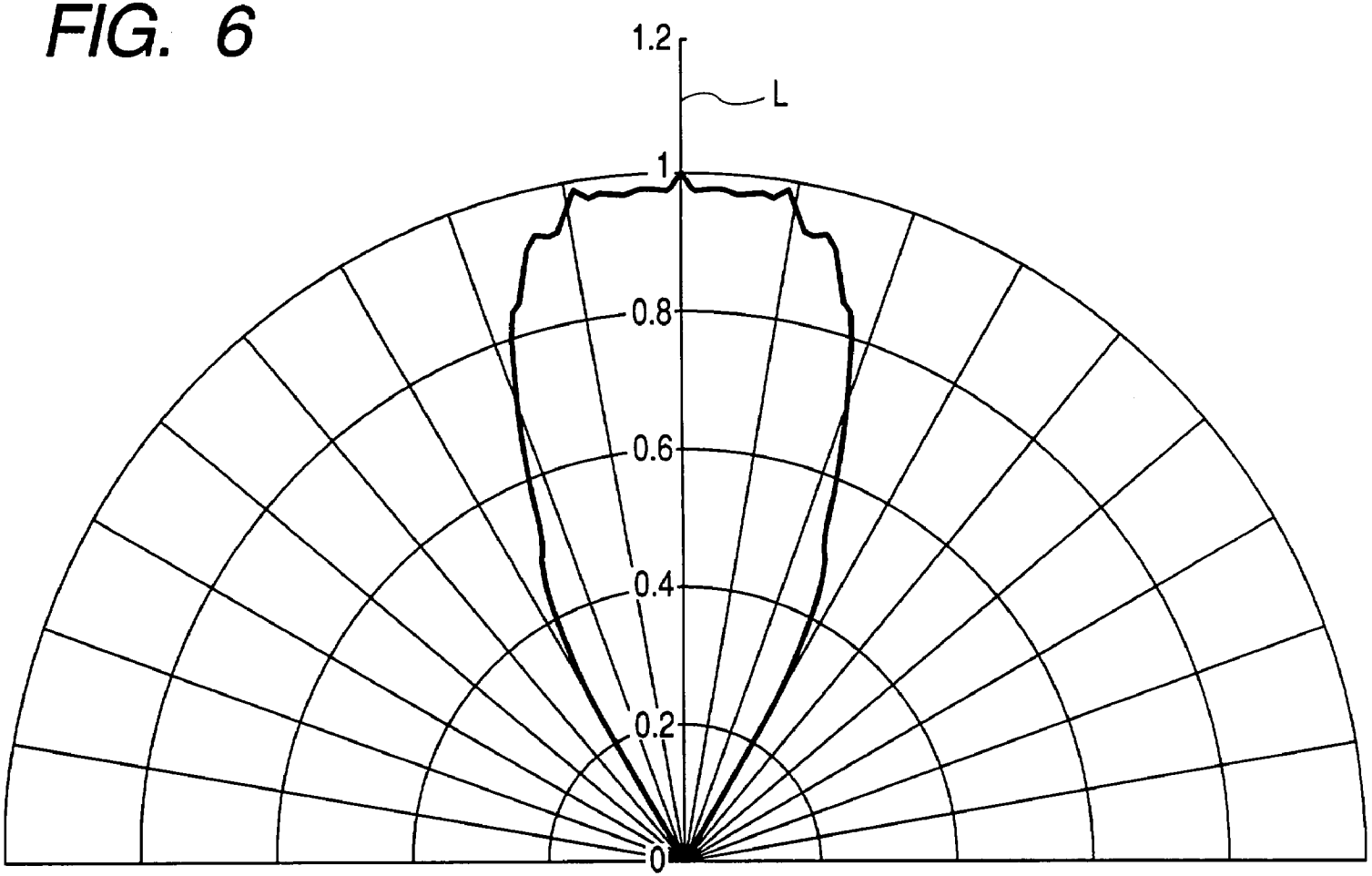
FIG. 6 shows a light distribution characteristic obtained by the construction of the optical system according to the first embodiment of the present invention.
Figure 8:
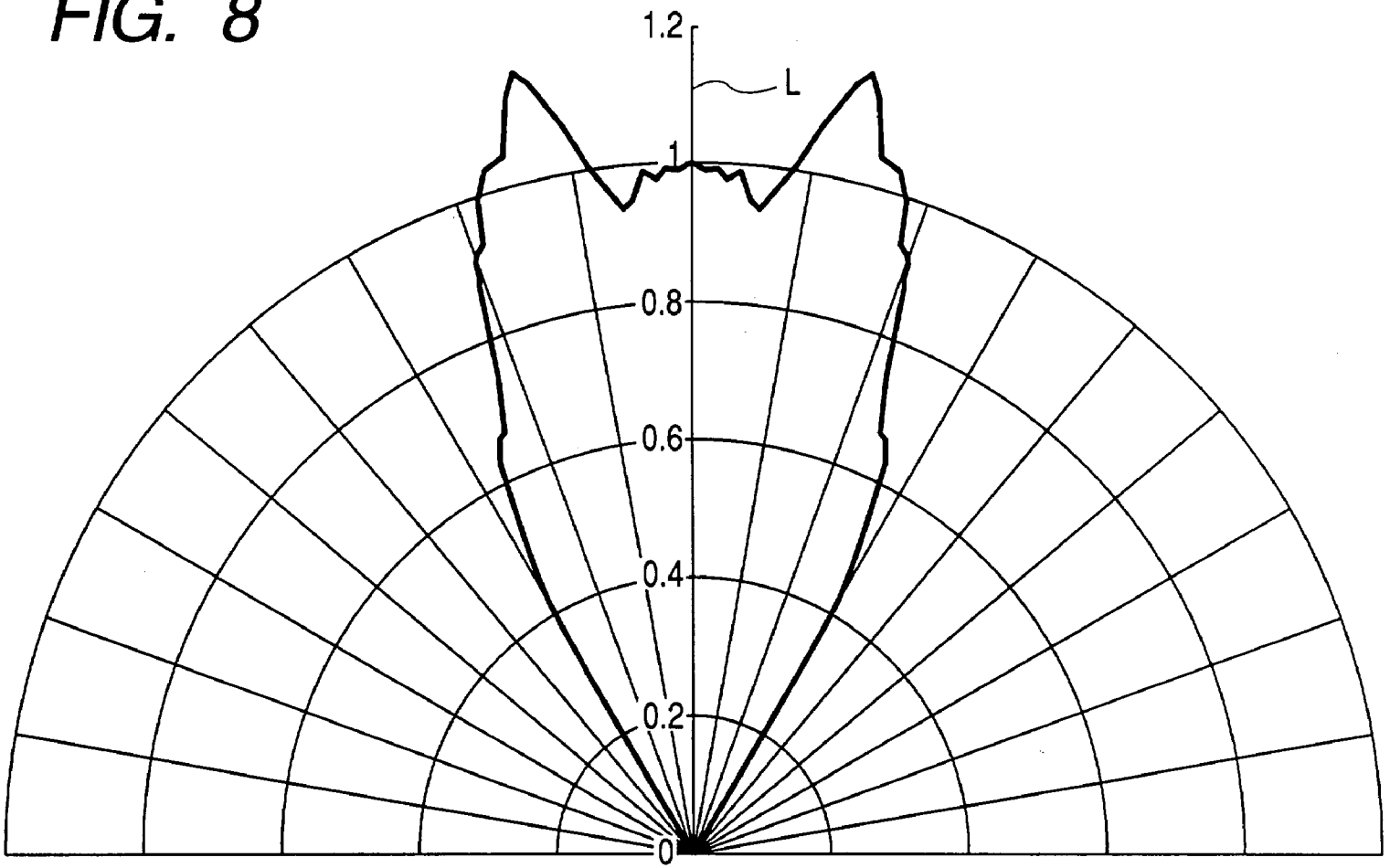
FIG. 8 shows a light distribution characteristic obtained by the construction of the conventional optical system of FIGS. 11A, 11B, 11C and 11D.
Figure 10:
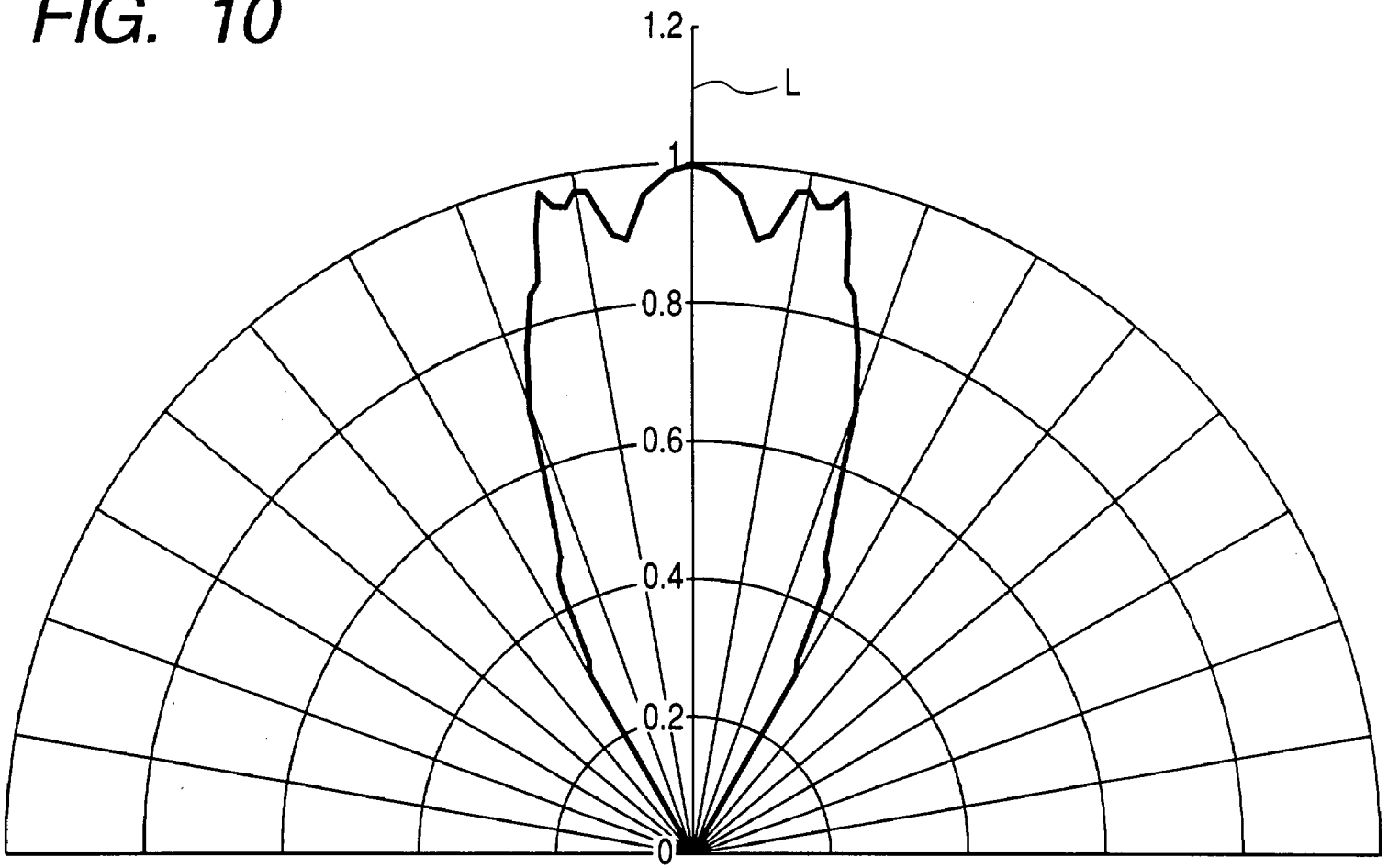
FIG. 10 shows a light distribution characteristic obtained by the construction of the optical system of FIGS. 9A, 9B, 9C and 9D.

FIGS. 6, 8 and 10 are figures which continuously obtain and show the above-described substance with respect not only to a particular angle, but also to each angle component on the irradiated surface (light distribution characteristic distribution figures). The present embodiment corresponds to FIG. 6, the example of the prior art corresponds to FIG. 8, and the modification of the present embodiment corresponds to FIG. 10. A straight line L indicates the center of irradiation, and continuously links and shows the rates of intensity (the distance being constant) of the respective angle components when the intensity of the central portions of irradiation is 1.0. The right side and left side with the irradiation center line L as the boundary indicate the upward and downward light distribution states, respectively.

First, when the upper and lower reflecting surfaces 103*b* and 103*b*' of the reflector 103 in the example of the prior art shown in FIGS. 11A to 11D are formed by flat surfaces, as shown in FIG. 8, as the direction of irradiation is changed, the component concerned in each direction of irradiation gradually changes in such a manner that the reflected light by the upper surface first disappears, and then the component of the direct light disappears. In case of this change, a distinct difference between light and shade occurs, and is recognized as uneven light distribution by the human eyes. Particularly when the emergence surface of the optical member 104 is a flat surface, a two-time reflected light component reflected once by each of the reflector 103 and the optical member 104 suddenly increases from a certain constant angle (in the present embodiment, the vicinity of 6°), and the change in brightness is remarkable. Together with this, this phenomenon progresses on each cross section substantially at the same time, and on the irradiated surface, distinct linear light and shade, i.e., uneven light distribution, occurs in parallelism to the axial direction of the flashlight discharge tube. The human sense very sensitively responds to the linear difference between light and shade, and even a slight difference between light and shade is liable to be recognized as uneven light distribution.

Also, in the construction of the modification of the present embodiment in which the upper and lower widening reflecting surfaces 3*b* and 3*b*' of the reflector 3 shown in FIGS. 9A to 9D are made into such a shape that the area of the opening portion increases toward the opening portion, as shown in FIG. 10, this light and shade portion occurs as in the above-described example of the prior art shown in FIG. 8, but the difference between light and shade is smaller than the difference between light and shade shown in FIG. 8 and a remarkable peak becomes null, and it can be said that uneven light distribution is alleviated.

On the other hand, in FIG. 6 showing the embodiment of the present invention, in order to make it difficult for such linear difference between light and shade to occur, there is adopted a method of minimizing the area in which the above-described optical path does not exist, providing a new optical path in the area wherein the optical path does not exist so as not to cause a sharp difference between light and shade, and further obscure the state of the area of changeover so as not to cause a change in light and shade at the same time. Thereby, it has become possible to obviate uneven light distribution.

As shown, in the light distribution characteristic graph by the present embodiment, the optical system is such that no conspicuous difference between light and shade occurs in the area. of about 5° to 10°, while in FIG. 8 showing the example of the prior art, it will be seen that a great difference between light and shade occurs in this angle area of 50° to 10°, and that this provides the conventional lateral stripe-shaped uneven light distribution. As described above, by adopting such a countermeasure as shown in the present embodiment, it is possible to obviate uneven illuminance which causes such difference between light and shade.

As described above, in an illuminating optical system utilizing the plural-time reflection by the total reflection by the reflector or the optical member, uneven light distribution is liable to occur at the point of changeover of each reflecting layer thereof, but by contriving the shape of the vicinity of the emergence surface of each reflecting surface as shown in the present embodiment, a great change in illuminance is not caused even for the irradiation in each irradiation angle direction, and an illuminating optical system given a uniform light distribution characteristic can be achieved.

Also in uniformizing the light distribution in this case, a countermeasure for uneven light distribution can be adopted easily without requiring any diffusing surface on the optical path and therefore, the loss of energy by the irradiation to the outside of a necessary angle of view is small and the influence imparted to the general shape and size of the optical system is also small, and this provides a very efficient countermeasure for uneven light distribution.

The present invention is not restricted to the constructions shown in FIGS. 5A to 5D and FIGS. 9A to 9D, but may be a combination of the optical member 4 of FIGS. 1A and 1B and the reflector 103 shown in FIGS. 11A to 11D.

A second embodiment of the present invention will now be described with reference to FIG. 7.

Figure 7:
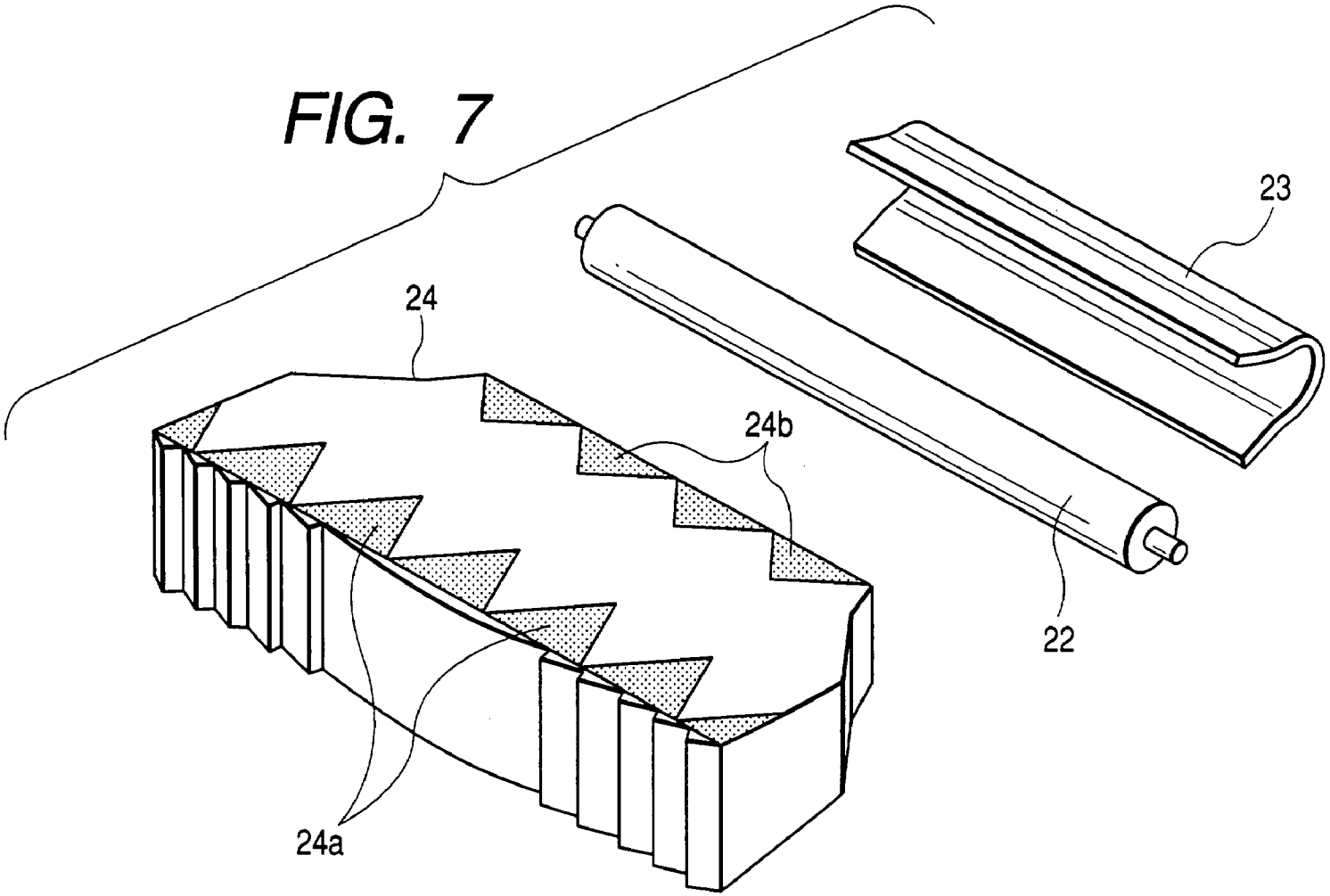
FIG. 7 is an exploded perspective view of only the main optical system of a flashlight emitting apparatus according to a second embodiment of the present invention.

FIG. 7 shows an illuminating apparatus according to the second embodiment of the present invention, and particularly in this embodiment, a flashlight emitting apparatus, and shows a perspective view of only the main optical system thereof.

In FIG. 7, the reference numeral 22 designates a flashlight discharge tube (xenon tube), and the reference numeral 23 denotes a reflector having a construction substantially similar to that of the first embodiment. The reference numeral 24 designates an illuminating beam directing optical member for causing a beam directly emitted from the flashlight discharge tube 22 and the beam reflected by the reflector 23 and incident thereon to be efficiently applied to the object side. As in the first embodiment, an optical resin material of high transmittance such as acrylic resin or a glass material is suitable as the material of the optical member 24.

This second embodiment is an embodiment using a necessary minimum diffusing surface as means for alleviating uneven light distribution, and prevents the general shape from becoming bulky and hardly causes the deterioration of the optical characteristic, and diffuses only a minimum necessary component affecting uneven light distribution. A method of setting this optimum shape will hereinafter be described in greater detail with reference to FIG. 7.

FIG. 7 is an exploded perspective view of the light emitting optical system of the flashlight emitting apparatus according to the second embodiment of the present invention. In order to achieve the uniformization of the light distribution characteristic, diffusing surfaces 24*a* becoming higher in the degree of diffusion toward an emergence surface are formed on the upper and lower surfaces near the emergence surface of the optical member 24, and diffusing surfaces 24*b* highest in diffusing property near an incidence portion and gradually falling in the degree of diffusion away from the incidence portion are formed near an-incidence surface.

In the present embodiment, as a method of enhancing the degree of diffusion, there is adopted a method of making the degree of diffusion of the diffusing surfaces themselves constant, and varying the degree of diffusion by a variation in the area of the diffusing surfaces. For example, the present embodiment is designed such that as shown, a plurality of triangular diffusing surfaces each having as the base such an emergence surface that the diffusing surfaces 24*a* become wider in area toward the emergence surface of the optical member 24 are arranged to thereby provide the above-described effect. While in the shown embodiment, it seems that these diffusing surfaces are formed only on the upper surface, similar diffusing surfaces are also formed on the lower surface.

As described above, the diffusing surfaces 24*a* are formed on all of the upper and lower reflecting surfaces of the optical member 24 and the degree of diffusion thereof is increased toward the vicinity of the emergence surface, whereby an effect similar to that of the first embodiment can be obtained. That is, a discontinuous area is formed between the reflected light by the upper and lower reflecting surfaces of the optical member 24 and a beam directly emerging without the intermediary of the reflecting surfaces and uneven light distribution is liable to be created on the irradiated surface, but diffusing surfaces are formed in this area, whereby the component in a non-uniform area can be scattered, and an illuminating optical system given a uniform light distribution characteristic can be realized.

Similarly to this, again in the incidence portion of the optical member 24, with respect also to the discontinuous point of the reflected light by the reflector 23 and the totally reflected light near the incidence portion of the optical member 24, the area of the diffusing portion is gradually varied toward the optical axis, as described above, whereby the uniformization of light distribution can be achieved.

While in the above-described embodiment, there has been shown an example in which the diffusing surfaces are formed on both of the emergence surface side and incidence surface of the optical member 24, the present invention is not always restricted to the construction in which the diffusing surfaces are formed on both sides, but the diffusing surfaces may be formed on only one of the two sides. With regard also to the shape of the diffusing surfaces, in the present embodiment, triangular diffusing surfaces are formed, whereas this shape is not restrictive, but other shape may also be adopted, such as a shape in which the diffusing property is gradually changed near an area forming the discontinuous point. Also, as described in detail in the first embodiment, design may be made so as to vary the diffusing property of the reflector to thereby obtain a substantially similar effect. For example, design may be made so as to effect the treatment of the diffusing surfaces on a portion of the vicinity of the emergence portion of the reflector 23, whereby the change in the light distribution around the boundary portion can be done smoothly.

Further, while in the present embodiment, the diffusion near the boundary portion of each reflecting surface is effected by an increase or decrease in the area of the diffusing portion, the present invention is not always restricted to this embodiment, but design may be made so as to change the diffusing property by a change in shape, and to increase the diffusing property of the vicinity of the boundary surface as compared with the surrounding shape. By designing so, there is obtained an effect substantially equal to that of the above described second embodiment.

As described above, by adopting such a shape as gradually changes the diffusing property near a place forming the changing portion of each optical member, it is possible to obtain a uniform light distribution characteristic suffering little from the difference between light and shade on the irradiated surface.

As has hitherto been described, according to the present invention, in an illuminating optical system of a vertically thin flat type, it has become possible to direct light to a Fresnel lens by side reflection to thereby effectively utilize the light which has so far been not utilized. Also, lateral stripe-shaped uneven light distribution liable to occur unavoidably in terms of structure can be prevented by a construction using necessary minimum parts without the addition of costly optical parts. Moreover, at this time, any extra space is required in the longitudinal direction of the optical system, and in terms of the optical characteristic as well, the component which originally need not be diffused need not be diffused and therefore, very efficient light distribution control becomes possible.

What is claimed is:

1. An illuminating apparatus comprising:

a light source comprised of a light emitting tube; and an optical unit disposed forwardly on the object side of the light source;

the optical unit being provided with an incidence surface on which light from the light source is incident, a light emergence surface provided with a Fresnel lens, and a side reflecting surface for totally reflecting the light incident on the incidence surface toward the Fresnel lens, said side reflecting surface being one of the side reflecting surfaces formed on both sides of the of the lengthwise direction of the light emitting tube and making an angle ranging between 85 degrees to 95 degrees to a lengthwise direction of the light emitting tube;

wherein the light totally reflected by the side reflecting surface is refracted by the edge surface of the Fresnel lens and emerges toward the object side thereof and wherein and the vertical angle of the Fresnel lens is formed along a direction perpendicular to the lengthwise direction of the light emitting tube.

2. An illuminating apparatus according to claim 1, further comprising a reflecting member disposed on a side of the light source which is opposed to the optical unit for reflecting the light from the light source to the optical unit side.

3. An illuminating apparatus comprising:

a light source; and an optical unit disposed forwardly on the object side of the light source;

the optical unit being provided with an incidence surface on which light from the light source is incident, a reflecting surface for totally reflecting some of the light incident from the incidence surface, and a light emergence surface;

wherein a diffusing portion is formed on at least a portion of the reflecting surface, said diffusion portion near the incidence surface having a higher degree of diffusion toward the incidence surface and near the emergence surface having a higher degree of diffusion toward the emergence surface.

* * * * *

UNITED STATES PATENT AND TRADEMARK OFFICE

CERTIFICATE OF CORRECTION

PATENT NO. : 6,974,236 B2
APPLICATION NO. : 10/354744
DATED : December 13, 2005
INVENTOR(S) : Yoshiharu Tenmyo It is certified that error appears in the above-identified patent and that said Letters Patent is hereby corrected as shown below:

Column 11, line 27, delete "$\mathrm{Sin}(\alpha)\cong n*\mathrm{Sin}(\theta)$" and insert --$\mathrm{Sin}(\alpha)\simeq n*\mathrm{Sin}(\theta)$--

Column 12, line 14, delete "$R30 \leqq \beta \leqq R300$" and insert --$R30\leq\beta\leq R300$--

Signed and Sealed this

Twenty-second Day of August, 2006

JON W. DUDAS
*Director of the United States Patent and Trademark Office*